US006253385B1

(12) United States Patent
Fields

(10) Patent No.: US 6,253,385 B1
(45) Date of Patent: Jul. 3, 2001

(54) TROUSER ORNAMENT

(76) Inventor: Stephen J. Fields, 400 N. First St., #311, Minneapolis, MN (US) 55401

( * ) Notice: Subject to any disclaimer, the term of this patent is extended or adjusted under 35 U.S.C. 154(b) by 0 days.

(21) Appl. No.: 09/624,257

(22) Filed: Jul. 26, 2000

(51) Int. Cl.[7] ..... A41D 1/06
(52) U.S. Cl. ..... 2/246; 2/244; 2/227
(58) Field of Search ..... 2/244, 246, 227; 24/488, 455–563, 462–67 R, 530, 543–547, 570, 485; D11/78.1, 215

(56) References Cited

U.S. PATENT DOCUMENTS

| | | | | |
|---|---|---|---|---|
| D. 135,753 | * | 6/1943 | Graeter | D11/78.1 |
| D. 142,357 | * | 9/1945 | Younghusband | D11/78.1 |
| D. 142,718 | * | 10/1945 | Kirsch | D11/78.1 |
| D. 164,685 | * | 10/1951 | Haltom | D11/781 |
| D. 175,981 | * | 11/1955 | Rubeck | D11/78.1 |
| D. 363,453 | * | 10/1995 | Herdt | D11/78.1 |
| D. 390,493 | * | 2/1998 | Fletcher | D11/78.1 |
| D. 400,466 | * | 11/1998 | Gleason | D11/78.1 |
| D. 409,464 | * | 5/1999 | Garza | D8/34 |
| 1,325,929 | | 12/1919 | Pasnik . | |
| 1,366,153 | | 1/1921 | Bangs . | |
| 1,366,929 | | 2/1921 | Dalrymole . | |
| 1,761,834 | | 6/1930 | King et al. . | |
| 3,605,300 | | 9/1971 | Moore . | |
| 4,361,936 | | 12/1982 | Kurashima . | |
| 4,558,469 | | 12/1985 | Richter . | |
| 4,922,553 | | 5/1990 | Morrose . | |
| 5,136,726 | | 8/1992 | Kellin et al. . | |
| 5,459,947 | | 10/1995 | Lasher . | |
| 5,845,422 | | 12/1998 | Valeteay III . | |

* cited by examiner

*Primary Examiner*—Gloria M. Hale
(74) *Attorney, Agent, or Firm*—Angenehm Law Firm, Ltd; N. Paul Friederichs

(57) ABSTRACT

A trouser ornament generally including an upper portion, a lower portion, and a connector portion for connecting the upper and lower portion; the portions being arranged such that the trouser ornament is preferably placed about the fly of a pair of trousers wherein the upper portion rests on and extends across at least a portion of the top surface of the fly, the lower portion rests on and extends across at least a portion of the bottom surface of the fly and the connector portion is preferably maintained at the edge of the fly.

20 Claims, 3 Drawing Sheets

TROUSER ORNAMENT

FIELD OF THE INVENTION

This invention relates to ornaments which may be applied to clothing, and more particularly, to a clip which is used to accentuate the fly on trousers.

BACKGROUND OF THE INVENTION

Numerous types of clothing enhancement articles have been patented. Those that have been patented generally address the enhancement or accentuation of that type of clothing worn about the upper torso of the body, e.g., shirts, blouses, jackets, vests, etc., or, alternatively, the enhancement or accentuation of footwear.

For example, as to the former, U.S. Pat. No. 3,605,300 describes a badge that may be used to enhance or accentuate the epaulet of a uniform. U.S. Pat. No. 4,361,936 describes a unique cufflink that may be used to enhance or accentuate the cuff of a shirt. U.S. Pat. No. 4,558,469 describes a triangularly shaped trim article that may be used to enhance or accentuate the collar of a shirt or jacket. And, U.S. Pat. No. 4,922,553 describes a support device that may also be used to enhance or accentuate the collar of a shirt or jacket.

As to the latter, U.S. Pat. Nos. 1,325,929, 1,366,929, 1,366,153, and 1,761,834 disclose ornaments that may be attached to the upper of a pump-style shoe to enhance or accentuate the shoe. U.S. Pat. No. 5,136,726 describes a hook and loop decoration that may be placed in any location on a fabric shoe to enhance or accentuate the shoe. And, U.S. Pat. Nos. 5,459,947 and 5,845,422 describe articles that may engage or be placed atop the laces of a shoe to enhance or accentuate the shoe.

An area where clothing ornamentation has seemingly been ignored is that of trousers, especially the fly of trousers.

SUMMARY OF THE INVENTION

A trouser ornament of the present invention substantially addresses that ignored area of ornamentation as described above. The trouser ornament generally comprises an upper portion, a lower portion and a connector portion of connecting the upper and lower portion. The trouser ornament is preferably placed about the fly of a pair of trousers wherein the upper portion rests on and extends across at least a portion of the top surface of the fly and the lower portion rests on and extends across at least a portion of the bottom surface of the fly. The connector portion is preferably maintained at the edge of the fly.

The upper and lower portions are preferably rectangular in shape while the connector portion preferably comprises an elbow or a hinge bracket. Trouser ornament may be held in position relative the fly of the rousers by virtue of friction between the trouser ornament and the fabric comprising the fly. Alternatively, trouser ornament may be provided with a manner of clamping itself to the fly, e.g., tightening the upper portion to the lower portion by virtue of a hinge bracket or angular shape of trouser ornament itself. Additionally, trouser ornament may be equipped with a rough surface and/or gripping teeth to enhance the hold of the trouser ornament to the fly.

Trouser ornament may be made of any suitable material, e.g., plastics, nylons, but is preferably made of metal so as to allow the user to decoratively enhance the upper portion of trouser ornament with logos and/or artistic designs. Upper portion may be otherwise creatively enhanced as well.

DESCRIPTION OF THE DRAWINGS

FIGS. 3A–3C depict a first preferred embodiment of the trouser ornament of the present invention wherein FIG. 3A is a top plan view, FIG. 3B is a side plan view, and FIG. 3C is a top perspective view.

FIGS. 5A–5C depict an alternative embodiment of the trouser ornament of the present invention wherein FIG. 5A is top plan view, FIG. 5B is side plan view, and FIG. 5C is a top perspective view.

FIGS. 6A–6B depict another alternative embodiment of the trouser ornament of the present invention wherein FIG. 6A is a rear plan view and FIG. 6B is a side plan view.

DETAILED DESCRIPTION OF THE PREFERRED EMBODIMENTS

Figure 1:
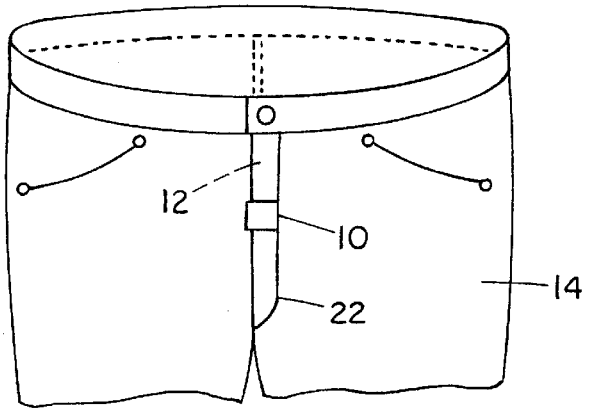
FIG. 1 is a front view of the upper portion of a pair of trousers, including the fly with the trouser ornament of the present invention applied thereto.
Figure 2:
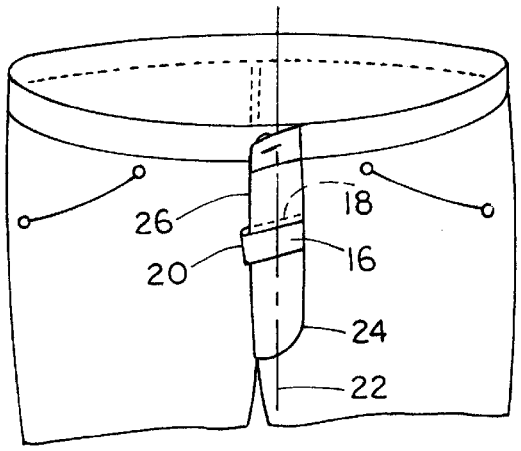
FIG. 2 is a perspective view of the fly of FIG. 1.

Referring to FIGS. 1 and 2, a trouser ornament 10 of the present invention is shown as preferably used and located on a fly 12 of a pair of trouser 14, wherein trousers 14 are defined as any type of clothing incorporating fly 12, e.g., pants, shorts, overalls. As shown, trouser ornament 10 is preferably of a clip design having an upper portion 16, a lower portion 18 and a connecting portion 20 that connects upper portion 16 to lower portion 18. Portions 16, 18 and 20 may be integral, homogenous, separate or other design that provides for securing the upper portion 16 to a fly 12. Upper portion 16 of trouser ornament 10 preferably extends across at least a portion of fly 12, and preferably, to at least the center of fly 12, as indicated by center line 22. Upper portion 16 may extend past center line 22 to seam 24 and beyond, keeping in mind that the farther past seam 24 upper portion 16 extends, the more difficult fly 12 will be to open. Upper portion 16 is preferably positioned atop fly 12 and lower portion 18 below fly 12, such that there is little or no room between edge 26 of fly 12 connecting portion 20; a large gap between edge 26 and connecting portion 20 may allow trouser ornament 10 to undesirably slide from a preferred position.

Figure 3A:
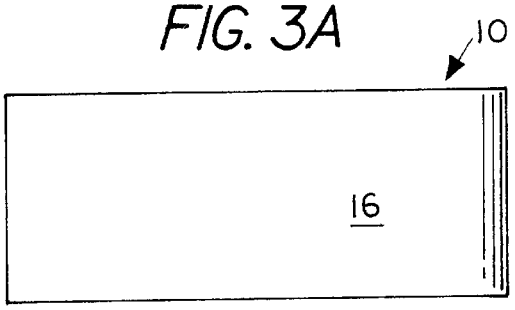
Figure 3B:
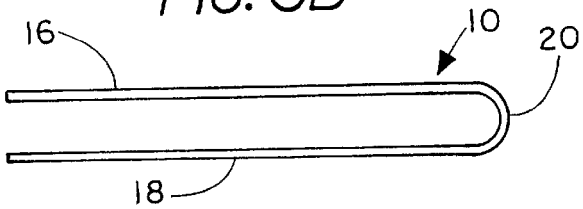
Figure 3C:
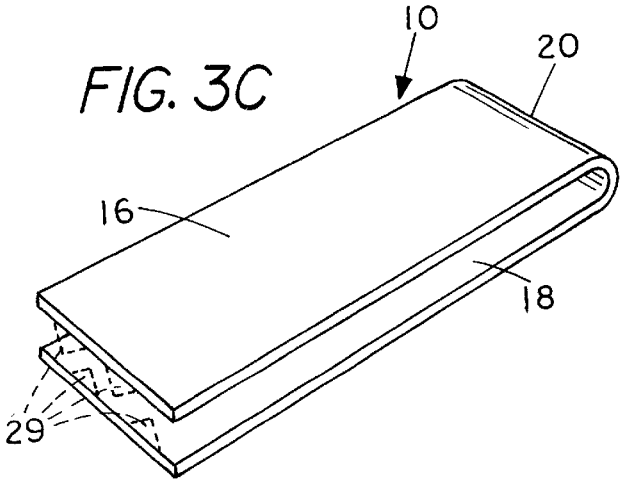

A preferred embodiment of trouser ornament 10 is shown in FIGS. 3A–3C. As shown, both upper portion 16 and lower portion 18 are preferably of substantially similar dimensions and are preferably rectangular in shape. However, it should be noted that upper portion 16 and lower portion 18 may have differing shapes and dimensions without departing from the spirit or scope of the invention. The upper portion 16 is anything that is decorative or supports a decorative feature, while the lower portion 18 is anything that assists in securing the upper portion 16 to the fly 12 regardless of its mode and manner of attachment to the fly 12. Connecting portion 20 is preferably an elbow extending across the full width of upper portion 16 and lower portion 18, and of sufficient height, e.g., approximately 0.1 to 0.5 inches, to accommodate edge 26 of fly 12. Connecting portion 20 is anything that provides the functional connection between the upper portion 16 and lower portion 18 and may help to maintain upper portion 16 at specific separation distance from lower portion 18 along the full length of upper portion 16. In this preferred embodiment, upper portion 16 and lower portion 18 are unitary with connecting portion 20 and, as such, are fabricated from a single material, which is preferably metal (however, other materials such as plastics may be used without departing from the spirit or scope of the invention).

The preferred embodiment of trouser ornament 10, as depicted in FIGS. 3A–3C, generally provides an integral type of clamping action in securing trouser ornament 10 to fly 12. That is, trouser ornament 10 is maintained in position of fly 12 by virtue of friction between the fabric from which fly 12 is made and trouser ornament 10 itself. Very smooth fabrics may present a difficulty in attempting to hold trouser ornament 10 in position. To enhance the frictional hold, trouser ornament 10 is preferably used on rough fabrics such as jeans. Alternatively, that side of upper portion 16, lower portion 18, and/or connecting portion 20 in contact with fly 12 may be roughened and/or provided with teeth 29 of any shape, indicated with dashed lines on FIG. 3B, to enhance the hold of trouser ornament 10 to fabric fly 12.

Figure 4:
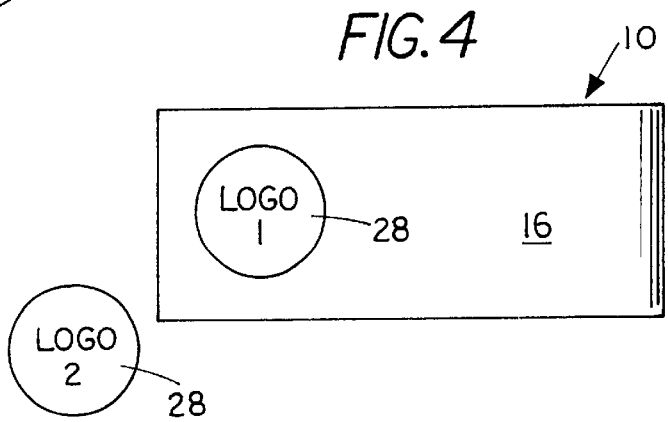
FIG. 4 depicts how magnets may be used to decorate the trouser ornament of the present invention.

Because, in the embodiment of FIGS. 3A–3C, trouser ornament 10 is preferably of metal, magnets 28 containing logos, slogans, designs, or other artistic creations may be used to decorate upper portion 16, See FIG. 4. This magnetic feature allows a user to change magnets 28 (artistic creations) as desired. Alternatively, upper portion 16 itself may be painted, etched, engraved or otherwise creatively enhanced.

Figure 5A:
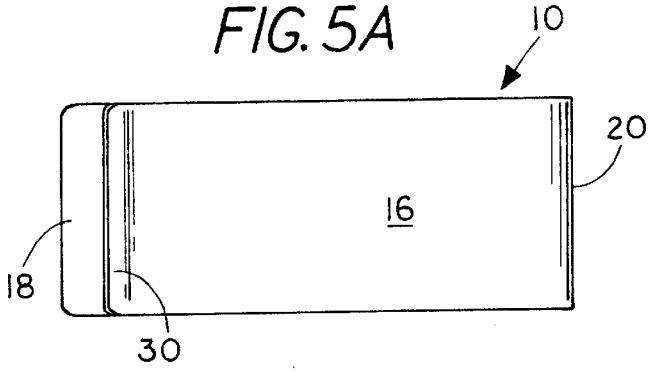
Figure 5B:
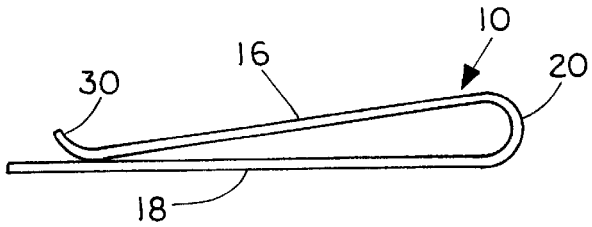
Figure 5C:
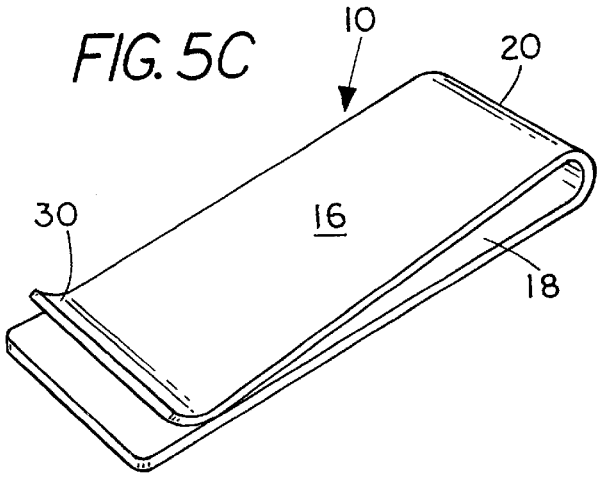

Referring to FIGS. 5A–5C, an alternative embodiment of trouser ornament 10 is depicted. Once again upper portion 16 and lower portion 18 are of a rectangular shape connected by connecting portion 20, which preferably comprises an elbow extending the full width of upper portion 16 and lower portion 18, and which is of sufficient height to accommodate edge 26 of fly 12. Of course other shapes and dimensions may be used without departing from the spirit or scope of the invention. In the embodiment of FIG. 5, upper portion 16 is presented at an acute angle to the substantially horizontal plane created by lower portion 18. In this manner, upper portion 16 is substantially clamped to lower portion 18 even when fly 12 is inserted between upper portion 16 and lower portion 18. Upper portion 16 is preferably provided with an upturned lip edge 20 which allows the user to more easily lift upper portion 16 from its substantially clamped position against lower portion 18 for insertion of fly 12.

In this embodiment, upper portion 16 and lower portion 18 are unitary with connecting portion 20 and as such, are fabricated from a single material, which is preferably metal (however, other materials such as plastics may be used without departing from the spirit of scope of the invention). Because, as with the earlier embodiment, trouser ornament 10 is preferably of metal, magnet 28 containing logos, slogans, designs, or other artistic creations may be used to decorate upper portion 16, see FIG. 4. This magnetic feature allows a user to change magnets 28 (artistic creations) as desired. Alternatively, upper portion 16 itself may be painted, etched, engraved or otherwise creatively enhanced. It should be noted that trouser ornament 10 of FIG. 5 may be reversed such that upper portion 16 becomes the lower portion presenting lip edge 30 at the back of fly 12 and lower portion 18 becomes the upper portion and each portion 16, 18 may have alternate designs thereon.

While trouser ornament 10 embodiment of FIG. 5 does provide a manner of clamping ornament 10 to fly 12 (e.g., the acute angle of upper portion 16 relative lower portion 18 that allows upper portion 16 to press against lower portion 18, that side of upper portion 16, lower portion 18, and/or connecting portion 20 in contact with fly 12 may be roughened and/or provided with teeth 18 to enhance the hold of trouser ornament 10 to fabric fly 12.

Figure 6A:
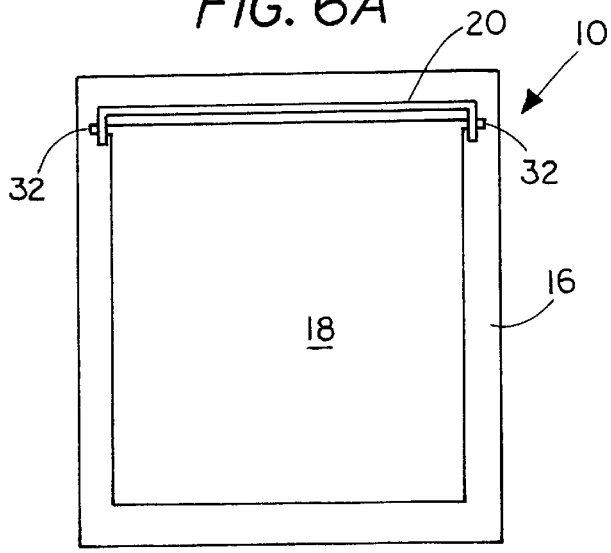
Figure 6B:
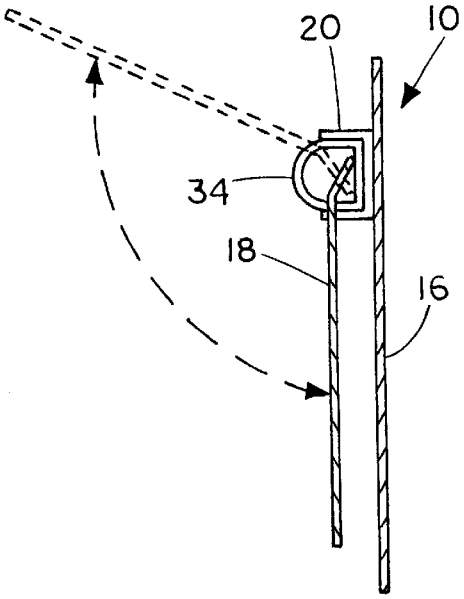

Referring to FIGS. 6A and 6B, a third embodiment of trouser ornament 10 is depicted. In this embodiment, upper portion 16 is a rectangular plate while lower portion 18 is a rectangular plate of a smaller dimension that is provided with a first and second side extension 32. Of course, other shapes and dimensions may be used without departing from the spirit or scope of the invention. Connecting portion 20 in this embodiment comprises a hinge bracket, secured to the bottom side of upper portion 16, incorporating a first and second aperture 34 for insertion of first and second side extensions 32. As such, lower portion 18 pivots relative stationary upper portion 16 and connecting portion 20. In this manner, lower portion 18 may be rotated towards upper portion 16 so as to clamp trouser ornament 10 to fly 12.

In the embodiment of FIG. 6, upper portion 16, lower portion 18 and connecting portion 20 are generally not of unitary configuration. As such, each portion may be fabricated from a different material, however, each is preferably fabricated from metal, to allow for the magnetic feature described above. As with the other embodiments, upper portion 16, in this instance, may be painted, etched, engraved, or otherwise creatively enhanced. Additionally, as with the other embodiments, the side of upper portion 16, lower portion 18 and/or connecting portion 20 in contact with fly 12 may be roughened and/or provided with teeth to enhance the hold of trouser ornament 10 to fabric fly 12.

The present invention may be embodied in other specific forms without departing from the essential attributes thereof; therefore, the illustrated embodiments should be considered in all respects as illustrative and not restrictive, reference being made to the appended claims rather than to the foregoing description to indicate the scope of the invention.

What is claimed is:

1. A trouser ornament and trouser combination, comprising:

a fly, said fly having a top surface and a bottom surface; and an ornament comprising an upper portion, a lower portion, and a connector portion connecting said upper and lower portions, wherein said upper portion rests on and extends across at least a portion of said top surface of said fly and wherein said lower portion rests on and extends across at least a portion of said bottom surface of said fly.

2. The ornament trouser combination of claim 1, wherein said fly is comprised of fabric, and wherein said upper portion of the ornament is maintained in a position on said fly by friction between said upper portion and of said fabric of said fly.

3. The ornament trouser combination of claim 1, wherein the upper portion, the lower portion, and the connector portion of the ornament are homogenous.

4. The ornament trouser combination of claim 3, wherein the upper portion of the ornament operates to substantially clamp said ornament to said fly.

5. The ornament trouser combination of claim 1, wherein said connector portion of the ornament comprises a hinge.

6. The ornament trouser combination of claim 1, wherein said upper portion of the ornament is manufactured from a material selected from a group consisting of: metal and plastic.

7. The ornament trouser combination of claim 1, wherein said upper portion of the ornament is comprised of a magnetic material and wherein said ornament further comprises a magnet that is removably attachable to said upper portion.

8. The ornament trouser combination of claim 1, wherein said ornament is provided with a gripping enhancement.

9. The ornament trouser combination of claim 8, wherein said gripping enhancement is selected from a group consisting of: a roughened surface and at least one gripping tooth.

10. A ornament and trouser combination, comprising:

a fly, said fly having a top surface, a bottom surface and a side edge connecting said top and bottom surfaces; and an ornament, said ornament having a top, a bottom, and a connector connecting the top and bottom, wherein said trouser ornament is disposed about said fly so that said connector is positioned proximate said side edge, said top is positioned atop said top surface of said fly, and said bottom is positioned against said bottom surface of said fly.

11. The ornament trouser combination of claim 10, wherein said top and bottom are substantially, removably clamped to said fly.

12. The ornament trouser combination of claim 10, wherein said connector. is selected from a group consisting of: an elbow and a hinge.

13. The ornament trouser combination of claim 10, wherein said bottom defines a plane and wherein said top is presented at an acute angle to said plane.

14. The ornament trouser combination of claim 10, wherein said fly is comprised of fabric and wherein said top and said bottom are maintained about said fly by friction between said fabric and said top and bottom.

15. The ornament trouser combination of claim 10, wherein said top is comprised of a magnetic material, and wherein said trouser ornament further comprises a magnet that is removably attachable to said top.

16. A ornament and trouser combination, comprising:

clip means for being slidably positionable about a fly; and securing means for securing said clip means in a desired position after said clip means has been slidably positioned about said fly.

17. The ornament trouser combination of claim 16, wherein said securing means is selected from a group consisting of a smooth surface of said clip means, a roughened surface of said clip means, at least one gripping tooth, and a clamp formed by a close positioning of an upper portion and a lower portion of said clip means.

18. The ornament trouser combination of claim 17, wherein said clips means comprises an open-ended loop.

19. The ornament trouser combination of claim 17, wherein said clip means comprises an upper portion, a lower portion, and connector portion connecting said upper and lower portions.

20. The ornament trouser combination of claim 17, further comprising of magnetic enhancement means for removably, magnetically securing to said clip means.

* * * * *